US011800609B2

(12) United States Patent
Buntrock et al.

(10) Patent No.: US 11,800,609 B2
(45) Date of Patent: Oct. 24, 2023

(54) METHOD AND APPARATUS FOR MELTING METAL USING MICROWAVE TECHNOLOGY

(71) Applicant: New Wave Ceramic Crucibles LLC, Williamsburg, VA (US)

(72) Inventors: Kermit Buntrock, Williamsburg, VA (US); Stan Morrow, Plant City, FL (US); Hugo Huey, Cupertino, CA (US)

(73) Assignee: New Wave Ceramic Crucibles LLC, Williamsburg, VA (US)

( * ) Notice: Subject to any disclaimer, the term of this patent is extended or adjusted under 35 U.S.C. 154(b) by 25 days.

(21) Appl. No.: 17/365,943

(22) Filed: Jul. 1, 2021

(65) Prior Publication Data

US 2022/0007473 A1 Jan. 6, 2022

Related U.S. Application Data

(60) Provisional application No. 63/047,425, filed on Jul. 2, 2020.

(51) Int. Cl.

| | |
|---|---|
| ***H05B 6/80*** | (2006.01) |
| ***B22D 41/06*** | (2006.01) |
| ***H05B 6/70*** | (2006.01) |
| ***F27B 3/06*** | (2006.01) |
| ***F27B 3/28*** | (2006.01) |
| ***H05B 6/78*** | (2006.01) |
| ***F27D 3/14*** | (2006.01) |

(52) U.S. Cl.

CPC ..... *H05B 6/80* (2013.01); *B22D 41/06* (2013.01); *F27B 3/065* (2013.01); *F27B 3/28* (2013.01); *H05B 6/707* (2013.01); *H05B 6/78* (2013.01); *F27D 3/14* (2013.01)

(58) Field of Classification Search

None

See application file for complete search history.

(56) References Cited

U.S. PATENT DOCUMENTS

| | | | | |
|---|---|---|---|---|
| 7,011,136 | B2 | 3/2006 | Moore et al. | |
| 2008/0272113 | A1* | 11/2008 | Rundquist | F27D 99/0006 219/690 |
| 2010/0252550 | A1* | 10/2010 | Dunn | H05B 6/784 219/700 |
| 2022/0007473 | A1* | 1/2022 | Buntrock | F27B 3/20 |

FOREIGN PATENT DOCUMENTS

CN 204589273 U * 8/2015

* cited by examiner

*Primary Examiner* — Scott R Kastler

(74) *Attorney, Agent, or Firm* — Harness, Dickey & Pierce, P.L.C.

(57) ABSTRACT

The present invention relates to a microwave melting apparatus and system for investment casting the metals obtained therefrom. In addition to enhanced production capacity, the system allows for the use of both a broad range of metal alloys and a variety of forms including ingot, scrap, granulated and powdered metals not possible with induction systems generally.

18 Claims, 4 Drawing Sheets

METHOD AND APPARATUS FOR MELTING METAL USING MICROWAVE TECHNOLOGY

CROSS-REFERENCE TO RELATED APPLICATION

This application claims the benefit of U.S. Provisional Application No. 63/047,425, filed on Jul. 2, 2020. The entire disclosure of the above application is incorporated herein by reference.

FIELD

The present disclosure relates to a method and apparatus for melting metal using microwave technology and the use of microwave melted metal in investment casting applications.

BACKGROUND

There was some early work done in microwave melting of metals but the technology had a number of limitations (see U.S. Pat. No. 7,011,136).

According to the above noted patent, metal is loaded into a crucible at room temperature outside of the microwave chamber and then loaded into the chamber. Thereafter, microwave energy is applied and after the cycle is complete, the chamber remained closed until the metal solidified and is not unloaded until it cooled to nearly room temperature. While this system generally works for small batches, it is very time consuming for a single melt and is clearly not suited for regular production, particularly investment casting. Thus, there is a need for a more efficient microwave melting and casting technology more suitable for more rapid metal melting and investment casting applications.

Most of the prior art for producing investment castings involves induction melting and a significant consumption of energy. Induction melting units involve placing a ceramic crucible (or "ceramic coating," hereinafter just referred to as the "crucible") inside a metal coil. More typically the crucible is cemented in position within the metal coil using a special ceramic cement.

Metal to be melted is placed in the crucible and an induction current can flow through a metal coil associated with the crucible. In order to yield high quality castings, the induction melting process needs to be carefully monitored for both quality and safety, and the metal must be pure and either in ingot form or thick pieces, typically ¼ inch thick or more. To avoid overheating of the coil, it is typically made hollow and water can flow through it. As the metal begins to melt significant eddy currents are produced in the melt. Over time and after several melt cycles the crucible side walls become thinner and thinner and the crucible fails. Often, there is a ceramic coating (cement) surrounding the crucible to provide extra "protection" of the metal coil. However, this too is eroded by the eddy currents which fail after additional heats are attempted. When this happens, there is a direct electrical short between the molten metal and the induction coil and an explosion of the molten metal may result. In addition to this inherent danger, the induction melting unit is essentially ruined by the electrical short, necessitating a costly repair.

Another difficulty with induction melting is its lack of flexibility to quickly change alloy types to be melted. Usually the same alloy is melted in a "campaign" so that there is no contamination of the alloy chemistry. In order to change the alloy to be melted, the induction unit needs to be shut down and a new crucible "cemented" in place within the induction coil. In addition to the labor time required, there is usually additional time required for the cement to "cure" or harden. Thus, changeover of alloys to be melted involves additional cost and significant down time of the production unit.

There is thus a need for a safer, more flexible, less costly, and more energy efficient process which addresses the disadvantages of induction melting. The present invention overcomes these disadvantages and is described in detail below.

SUMMARY

The present invention relates to an apparatus and method for melting metal using microwave energy and to the use of such metal for investment casting components. It offers numerous advantages over the prior art and is particularly well suited for producing precision metal castings such as are common in the investment casting process. Using microwave energy to melt metal is a very promising technology. The basic concept is to place a special crucible in a microwave field, where such crucible is constructed to absorb microwave energy while maintaining excellent refractoriness. Two versions are envisioned, namely, a "single" layer crucible designed to absorb microwave energy or a "double" layered crucible in which the outer crucible or layer is designed to absorb micro-wave energy typically utilizing materials such as silicon carbide and the inner crucible or liner is a highly refractory material such as aluminum oxide, zirconia, yttria, scandium oxide, or erbium oxide. In addition, to the special crucible technology, the present invention also relates to a special microwave melting and casting "furnace" into which the crucible is placed during melting.

Coupled to the furnace is a microwave energy delivering system including at least one microwave generator and a microwave wave guide assembly which offers a unique mechanism for transmitting microwave energy to the aforementioned crucible assembly. In essence, the delivery system allows for the tailoring of both the amount of microwave energy transmitted to the crucible assembly as well as the location at which the energy is directed to the crucible assembly. For example, the microwave guide assembly employs wave guide funnels disposed on opposing sides of the furnace assembly. The system can be "tuned" to provide specified levels of energy depending on the type of metal to be melted.

Another unique design features of this microwave melting and casting furnace is to allow both tilt pour and bottom pour of the molten metal. As will be described in greater detail below, bottom pouring is particularly useful for investment casting applications and is especially useful for high throughput investment casting.

The investment casting process is capable of producing a wide variety of metal parts to near net shapes and dimensions. It also makes possible the production of high integrity metal parts such as medical castings (i.e. artificial hips and knees), turbo charger castings for the automotive industry, and various aerospace castings including blades and vanes, by way of non-limiting example. For these special high integrity applications, very pure metal is required with a minimum of casting defects. Current technology prior to this invention relied on induction melting. Induction melting of metal is inherently difficult to produce pure metal parts; the induction melting process introduces slag into the melted metal due to the stirring action and eddy currents introduced into the molten metal. Various casting defects such as inclusions tend to occur. The technology of this invention produces very clean and pure molten metal without excess slag; heating of the metal is very uniform and the bottom pour innovation allows for better quality production since most of the impurities and the small amount of slag generated, if any, floats to the top of the melt and does not get poured into the investment casting shell mold which is currently not possible with induction systems. The invention also makes possible the melting of virtually all metals and alloys within a single unit, as any metal or alloy (ingot or scrap) can be placed in the melt crucible. Likewise, clean scrap, granulated and powdered metals can all be melted under this invention. The microwave system employed herein allows for the inter-granular spaces of the metal to act as sites for micro-arcs which in turn heat up the granular or powdered metal faster than is possible, if at all with induction heating. Cross contamination of metal alloys can be avoided by a simple and quick change over of the melting crucible.

It is well known by those skilled in the industry that high quality aluminum investment castings should not be melted in an induction furnace as an electric resistance melting unit is generally preferred. Induction melting of aluminum creates violent stirring of the metal heat, resulting in hydrogen embrittlement and excess dross. Thus, the production of high quality aluminum investment castings has heretofore required an additional melt unit different from the induction melt unit typically used for steel and nickel investment castings.

Until this invention, melting of titanium alloys for quality investment castings would require yet another separate metal melting unit too. Titanium and titanium alloys are very reactive in the molten state. Typically it is melted under a vacuum or inert gas in a water cooled copper "kettle." The titanium ingot and copper "kettle" are oppositely charged such that when the titanium ingot is placed near the copper kettle a short circuit is introduced which causes the titanium ingot to melt. The copper "kettle" is prevented from melting due to water cooling from underneath. A small amount of titanium freezes against the copper resulting in what is known as a titanium "skull." Although commonly employed, this method is not energy efficient and yields very little control of the super heat of the titanium; it is simply poured when it becomes liquid.

This invention overcomes these drawbacks and allows virtually any metal or metal alloy (i.e., steel, nickel, aluminum, titanium) to be melted in the same microwave unit, with a simple and quick change over of the melting crucible.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
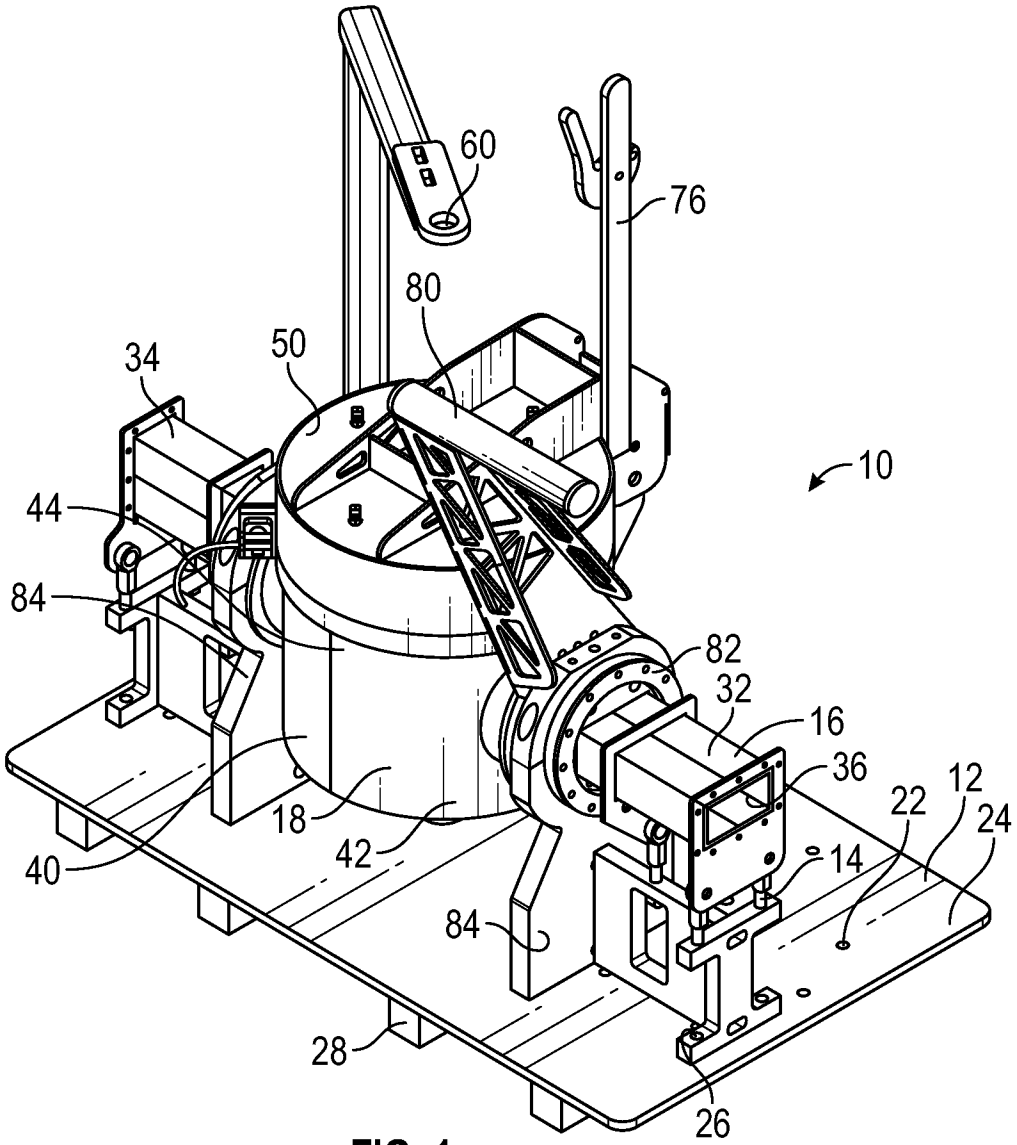
FIG. 1 is a detailed view of the microwave melting and casting furnace assembly.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The microwave melting system 10 of the present invention includes as its main components an adjustable platform 12, hydraulic assembly 14 for selective positioning of a microwave wave guide assembly 16, and a furnace assembly 18 and one or more microwave energy sources referred to herein as generators 20. Some or all of the aforementioned components are preferably made from durable lightweight metals, such as aluminum alloy and/or stainless steel.

The adjustable platform 12 includes a number of apertures 22 extending through a base 24 for receiving mounting bolts 26 to fix the assembly in place. The underside of the platform preferably includes a plurality of transversely disposed spaced apart beams 28 to enhance structural integrity. By elevating the platform via the beams, it is possible to move the entire microwave melting system assembly via a heavy duty hi-lo within a plant.

One of the unique design features of the microwave melting and casting furnace assembly 18 allows both tilt pour and bottom pour of the molten metal. Tilt pour allows for molten metal to be poured out of the top of the crucible upon opening the lid 50 via a lever mechanism 76 and associate spring assembly 78. As shown, bearing assemblies 82 are disposed over the wave guides and are coupled to the furnace housing. The furnace is tilted by rotating the articulating arm 80 which extends from the furnace housing downwardly. The bearing assemblies 82 are hosted by support members 84 anchored along the lower end to the platform. The apparatus can pour the molten metal from the top of the crucible without disconnecting the wave guides assembly which offers substantial time savings. Additionally, as will be described in greater detail below, the system 10 allows for bottom pouring of the molten metal too. These features make possible repetitive efficient metal melting for regular and productive investment casting production.

Numerous cycles, can be melted and poured in a single work shift not only because of the ease of either tilt or bottom pouring, but as a result of using specially designed crucibles that are easy to load and unload from the furnace. By using the special crucibles, production of a variety of different alloys in the same day is possible without any cross contamination of the various alloys.

Figure 4A:
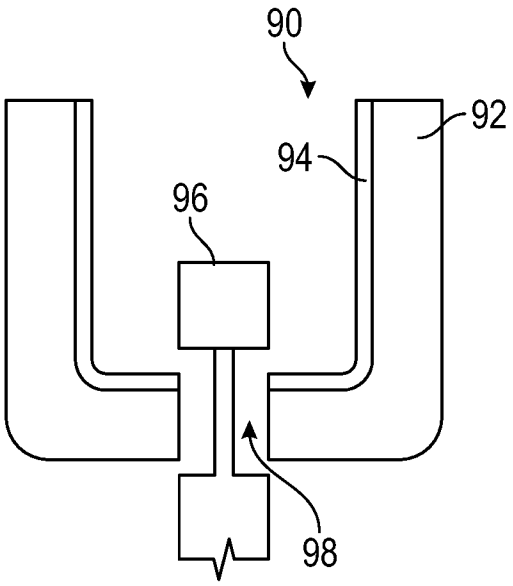
FIG. 4A is a cross-sectional view of a multi-layer ceramic crucible embodiment with the plug displaced.
Figure 4:
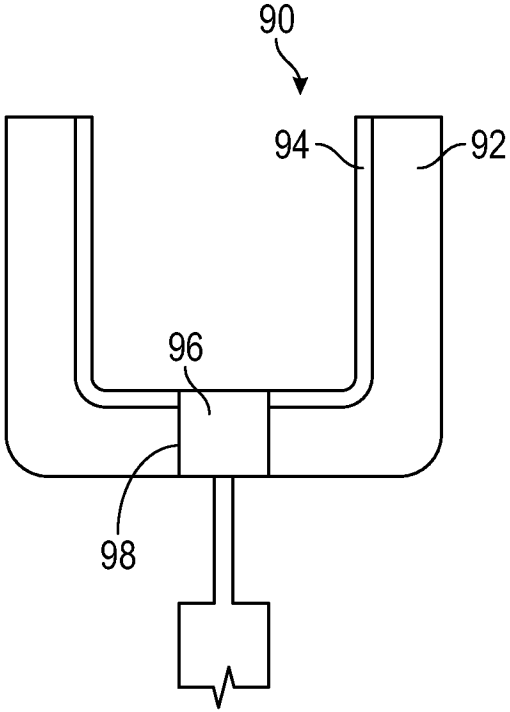
FIG. 4 is a cross-sectional view of a multi-layer ceramic crucible embodiment of the present invention.

The crucibles generally include an outer layer formed from a first refractory material which may include one or more microwave absorbers and an inner layer of a second refractory material which is resistant to sticking by the molten metal upon cooling as shown in FIGS. 4 and 4A. The inner layer of the crucible may be selectively removable from the outer layer of the crucible.

Two versions are envisioned, namely, a "single" layer crucible designed to absorb microwave energy or a "double" layered crucible in which the outer crucible layer 92 is designed to absorb micro-wave energy typically utilizing materials such as silicon carbide and the inner crucible 94 or liner is a highly refractory material such as aluminum oxide, zirconia oxide, yttria oxide, scandium oxide, or erbium oxide. The crucibles can be formed using a technique known in the ceramics industry as slipcasting.

For repetitive melting of the same alloy, crucible life is enhanced because of the uniform heating without any eddy currents eroding crucible sidewalls. This feature minimizes the resulting slag from crucible erosion so that the molten metal stays cleaner and improves casting yields. Cooling induction coils are no longer required with induction melting systems.

The system shown in FIGS. 1-4A may include one or more microwave generators 20 which can be operated, for example, at an ISM band centered at about 2.45 Ghz (2450 Mhz) microwave with 12 KW power supplies. Surprisingly at this low level up to about 30 lbs. of steel can be melted in about 15-20 minutes. The microwave generators can be obtained from various vendors, including Microdry Incorporated; CoberMuegge, LLC; or Ferrite Microwave Technologies; by way of non-limiting example. This system described can be scaled for use at an ISM band centered at about 0.915 Ghz (915 Mhz) with a power supply of up to 100 KW allowing tons of metal to be melted, for example. When two microwave generators are being used, simultaneous use of widely different frequencies (i.e., different ISM bands) is not recommended.

Also provided are two wave guides 32 and 34, respectively. FIG. 1 shows the positions of both a "horizontal" and "vertical" wave guides 32 and 34. The horizontal wave guide typically has a tunnel 36 through which the microwaves are transmitted which is wider and shorter whereas the vertical wave guide has a tunnel 38 which is taller than it is wide. By having this design microwave energy can be specifically directed at the crucible in a tuned manner.

There is a (quartz) window at the top of the furnace lid assembly 50 in order to allow viewing via a spectropyrometer 60 into the crucible in order to monitor the melt and pour temperature. There is shielding 52 in the form of alumina insulation around the top of the melting system to insure that there is no leakage of microwave energy. The alumina insulation increases efficiency and also protects in the rare event of a crucible failure.

Figure 2:
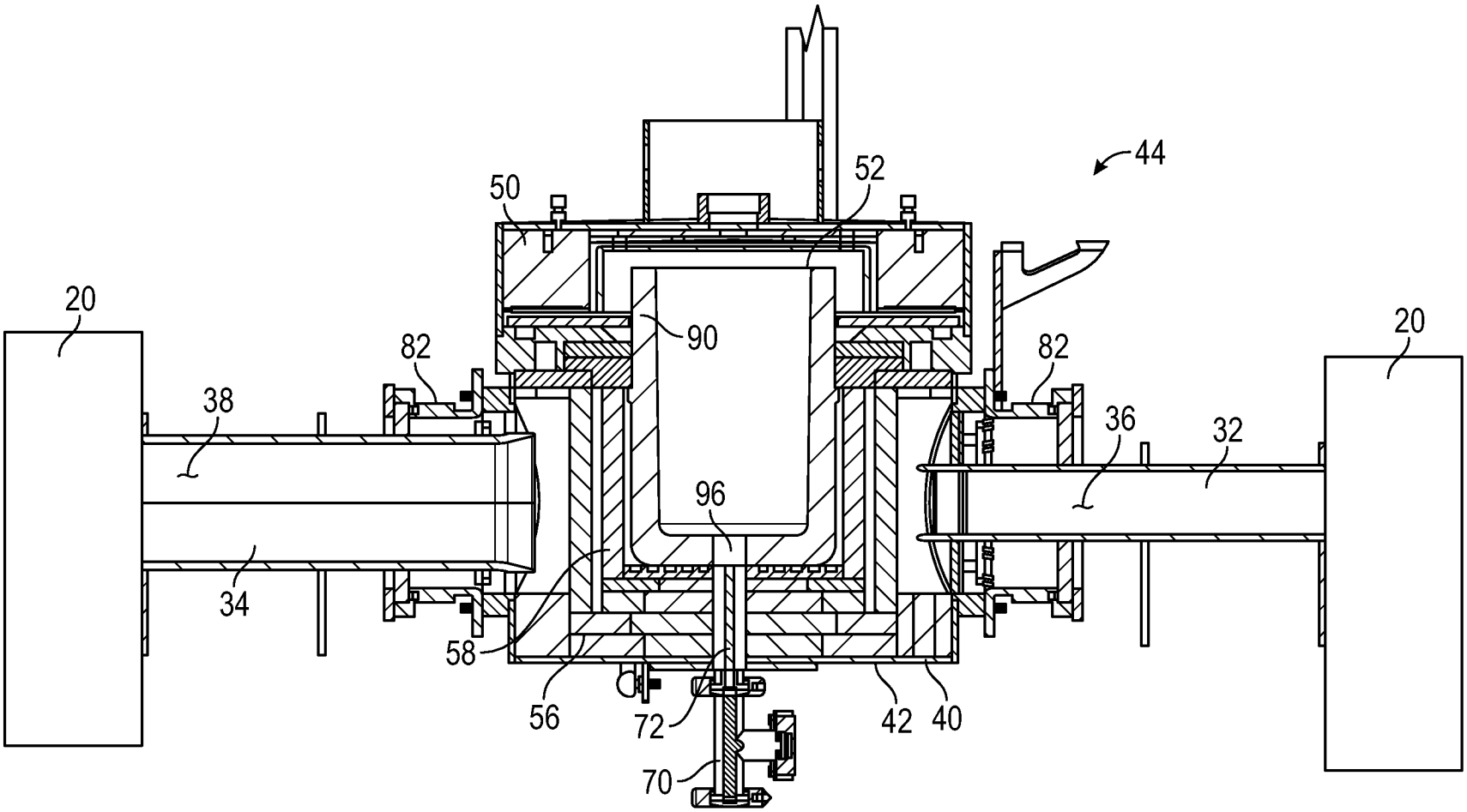
FIG. 2 is a cross-sectional view of the furnace assembly and the wave guide assembly of FIG. 1.
Figure 3:
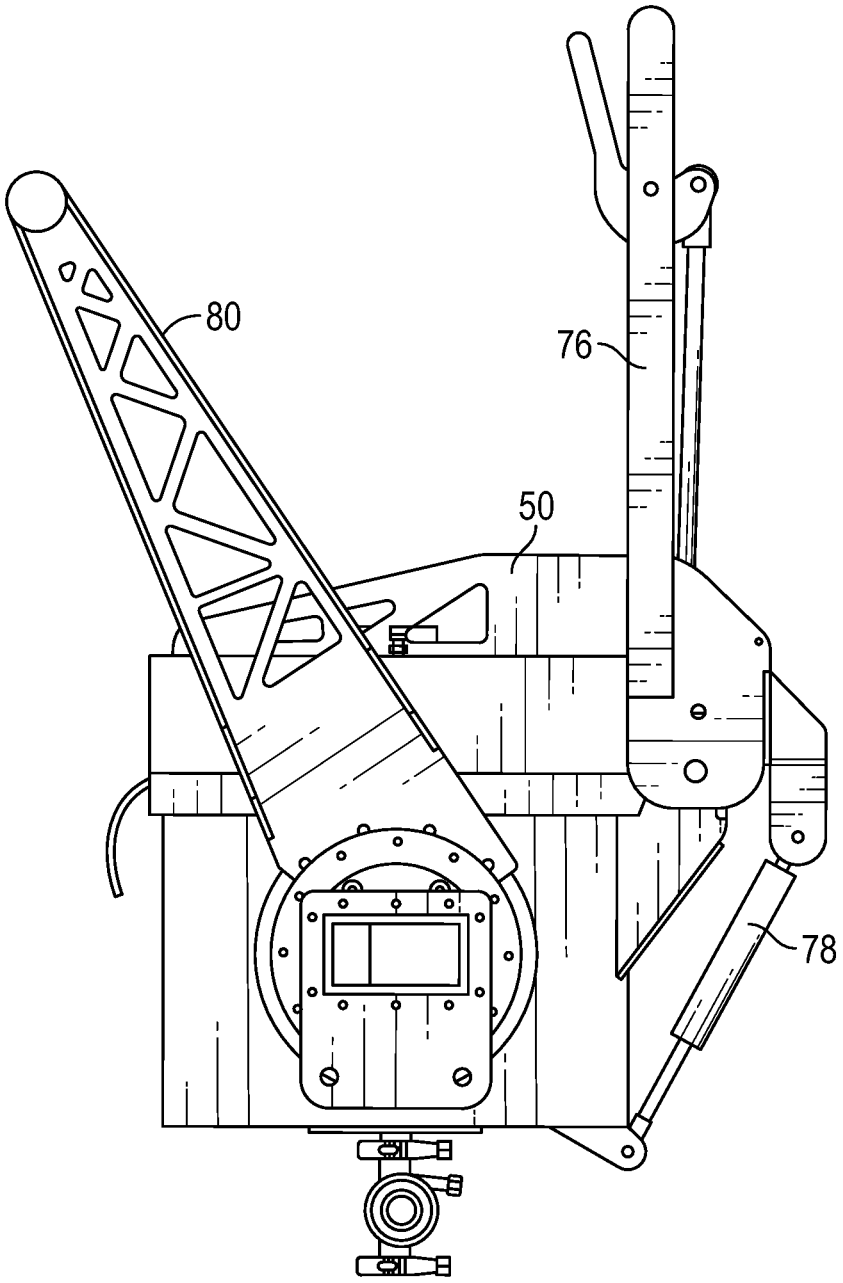
FIG. 3 is a side view of the furnace assembly and associated lever and spring assembly.

Referring to FIG. 2, a cross-sectional view is provided which offers more detail of the furnace assembly 18, the wave-guide assembly 20, and crucible 90, respectively. For example, the furnace assembly includes a housing 40 defined by the bottom portion 42 and top portion 44 hosting the lid assembly 50. Disposed within the housing are the key furnace chamber components including the refractory package 56, at the base of the housing, the crucible 90 for receiving the metal to be melted and a blanket 58 which wraps around a substantial portion of the crucible. The blanket is formed from a high temperature resistant fibrous material and serves to protect against damage to furnace in the unlikely event of an explosion.

Extending from the lower end of the outer shell is a pour valve assembly 70 to be utilized during "bottom pour" operations. Once the metal is sufficiently melted, a plug 96 at the bottom of the crucible is intentionally displaced to allow the molten metal to flow out of the valve assembly 70. The poor valve assembly 70 may include a remotely controlled solenoid valve 72 coupled to the crucible plug to both remove the plug 96 from the crucible opening 98 during pouring and to insert the plug back into the opening 98 during melting as shown in FIGS. 4 and 4A respectively.

In operation once the metal to be melted has been disposed within the crucible, the lid is closed and the microwave energy is applied to the crucible. As alluded to above the amount and frequency of the microwaves employed is a function of both the crucible composition and the metal to be melted. Generally speaking the frequency is such that the internal temperature of the furnace can be sustained at temperatures of between about 600° C. to about 1800° C. For example, and without limitation, aluminum alloys will require an average melt temperature of between about 650° C. to about 800° C.; copper, gold, lithium and bronze alloys will typically require sustained average melt temperatures of between about 900° C. and about 1100° C.; and stainless steel, carbon steel and nickel alloys will have an average melt temperature of between about 1500° C. and about 1700° C. Melt times will vary depending on the microwave frequency utilized, the metal alloy being melted and the size and shape of the metal to be melted.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for melting metals comprising:

a tiltable furnace assembly including a housing and at least one microwave energy absorbing ceramic crucible disposed within said housing for heating metal contained therein to its melting temperature;

a microwave energy source;

at least one microwave guide assembly attached to said furnace housing for directing microwave energy at predetermined levels to said at least one microwave energy absorbing ceramic crucible wherein upon sufficient energy heating of the microwave energy absorbing crucible through the application microwaves, the metal disposed therein is melted; and a valve assembly extending from the bottom of the housing through which melted metal can be poured.

2. The system of claim 1, wherein the valve assembly includes a remotely controlled solenoid valve.

3. The system of claim 1, wherein the at least one microwave energy absorbing ceramic crucible includes an opening along the bottom thereof and a selectively removable plug disposed in said opening and connected to the valve assembly, whereby upon displacement of the plug from the opening, the melted metal can be poured.

4. The system of claim 1, wherein the microwave energy absorbing ceramic crucible includes an inner layer of refractory material and an outer layer of microwave absorbent material.

5. The system of claim 1, further comprising a bearing assembly disposed between the furnace housing and the microwave guide assembly whereby said furnace housing is rotatably about the microwave guide assembly.

6. The system of claim 1, wherein said tiltable furnace assembly further comprises a removable lid connected to the housing whereby upon removal of the lid molten metal can be poured out of the top of the crucible.

7. The system of claim 1, wherein the at least one microwave guide assembly includes at least two microwave guides for directing microwave energy at said crucible.

8. The system of claim 7, wherein the at least two microwave guides direct microwave energy at the crucible from different directions.

9. The system of claim 8, wherein the two different directions are substantially opposing.

10. The system of claim 7, wherein each of said microwave guides include a tunnel through which the microwave energy is transmitted.

11. The system of claim 10, wherein said tunnel is shaped to tune the microwave energy being transmitted therethrough.

12. The system of claim 1, wherein the microwave energy source is a microwave generator capable of use at as ISM band of about 2.15 Ghz.

13. The system of claim 1, wherein the microwave generator is capable of use at an ISM band of up to about 0.915 Ghz.

14. The system of claim 1, further comprising a spectro photometer for monitoring the melting of the metal within the crucible.

15. The system of claim 1, further comprising shielding positioned over the crucible.

16. The system of claim 1, further comprising a refractory material disposed within the furnace housing and around the crucible.

17. The system of claim 1, further comprising a blanket which wraps around at least a portion of the microwave energy absorbing ceramic crucible.

18. The system of claim 17, wherein the blanket is formed from a high temperature resistant fibrous material.

* * * * *